United States Patent [19]

Müller et al.

[11] 4,245,399

[45] Jan. 20, 1981

[54] MATERIAL DRYER WITH AIR AND SCREW AGITATOR

[75] Inventors: Rudolf Müller; Hans-Jürgen Radeklau; Harald Doefke; Detlef Krieger, all of Berlin, Fed. Rep. of Germany

[73] Assignee: Schering Aktiengesellschaft, Berlin & Bergkamen, Fed. Rep. of Germany

[21] Appl. No.: 33,619

[22] Filed: Apr. 26, 1979

[30] Foreign Application Priority Data

Apr. 26, 1978 [DE] Fed. Rep. of Germany ..... 2818863

[51] Int. Cl.[3] ..... F26B 17/14

[52] U.S. Cl. ..... 34/166; 34/168; 34/181; 34/77; 366/152; 366/156

[58] Field of Search ..... 366/293, 152, 156; 34/166, 173, 77, 181, 168; 406/53, 136, 137, 138, 146

[56] References Cited

U.S. PATENT DOCUMENTS

| | | | |
|---|---|---|---|
| 2,799,947 | 7/1957 | Elwess | 34/77 |
| 3,075,298 | 1/1963 | Schaub | 34/173 |
| 3,452,965 | 7/1969 | Leister | 366/293 |
| 3,913,238 | 10/1975 | Updegrove | 34/181 |
| 4,109,966 | 8/1978 | Boyhont et al. | 406/60 |

FOREIGN PATENT DOCUMENTS

| | | | |
|---|---|---|---|
| 595603 | 2/1978 | U.S.S.R. | 34/181 |

*Primary Examiner*—Larry I. Schwartz
*Attorney, Agent, or Firm*—Millen & White

[57] ABSTRACT

Apparatus for drying products of various types including particulate materials having varying degrees of moisture content including those moistened throughout, as by organic solvents, and which may be tacky in nature; the apparatus including a generally cylindrical vessel with a downwardly conical lower portion terminating in a dried product discharge opening, and a gas inlet conduit arranged to deliver a drying gas to the vessel in the region of and slightly above the discharge opening at relatively low pressure but with auxiliary screw or propeller arrangements for preventing access of the product, particularly if tacky, to the gas inlet conduit and also serving to assist in distribution of the drying gas throughout the product as it is agitated and distributed in the vessel and in countercurrent as it tends toward the discharge opening.

10 Claims, 2 Drawing Figures

MATERIAL DRYER WITH AIR AND SCREW AGITATOR

BACKGROUND OF THE INVENTION

The invention relates to a discontinuously operating dryer for the drying of products which are moistened throughout, by organic solvents. Drying processes play an important part in industry and there are numerous devices to execute the drying process. Perhaps, the simplest type of dryer is the hurdle or baffle type dryer in which drying is very time-consuming and, in certain cases, takes an excessively long period of time, if the surfaces of the material to be dried become encrusted. In most instances, lumps are formed which require an additional comminuting process. Furthermore, charging and emptying of the hurdles or baffles are very cumbersome operations. The vane-type dryer works with high turbulence, leading to a comminution of the material to be dried which may be unsatisfactory under certain circumstances. Besides, this type of dryer cannot be used in connection with products tending to become tacky or encrusted. In case of a fluidized-bed dryer, the material to be dried must likewise be reasonably pourable and a very high amount of energy is required to maintain the fluidized bed. In case of a conical screw dryer, dry gas is fed from above to the moist product. The surface is constantly renewed by installed mixing equipment. However, this system is not suitable for large amounts of material because as the amount increases, the ratio of surface to volume decreases rapidly and the drying period increases exponentially. The same holds true for cylindrical mixers used simultaneously as dryers. These devices show improved space utilization and have a simpler mechanical structure than the conical screw dryers with a funnel-like shape of the vessel. However, difficulties are encountered in the known drying devices when called upon to rapidly dry large quantities of tacky products.

SUMMARY OF THE INVENTION

The problems to which this invention is directed have been solved by providing a more or less conventional dryer vessel with a dry gas feed means shortly above the product discharge opening of the vessel and a further feature resides in providing a driven single or double screw in the feed pipe for the dry gas. Another feature resides in that blades resembling a ship's propeller are arranged on an agitator shaft at the level of the dry gas inlet. The screws in the gas feed pipe are with the object of preventing the entrance of the moist product, especially if the latter is tacky, from the vessel into the gas feed pipe due to the bulk pressure and the pressure exerted by the agitating system. The blades at the level of the dry gas feed are with the object of effecting a drawing in of the dry gas by suction due to the vertical motion of the moist product, whereby the pressure of the dry gas can be maintained at a relatively low level.

DETAILED DESCRIPTION OF THE INVENTION

The agitator system includes blades having the shape and orientation of a ship's screw and of auxiliary agitating elements mounted along the agitator shaft in the form of a conveyor screw and resilient scrapers. The agitating aids are especially useful for the drying of tacky products. If the materials to be dried are moistened throughout by organic solvents, the latter must not be blown off into the atmosphere (antipollution law). In this case, a condenser is arranged in the circulated dryer gas stream. If the material to be dried is sensitive to atmospheric impurities, a sterile filter can be inserted in the dry gas conduit. To discharge the dried material in a dustfree fashion, the outlet of the vessel can be flexibly connected with a lid equipped with a rubber gasket.

DRAWINGS

Figure 1:
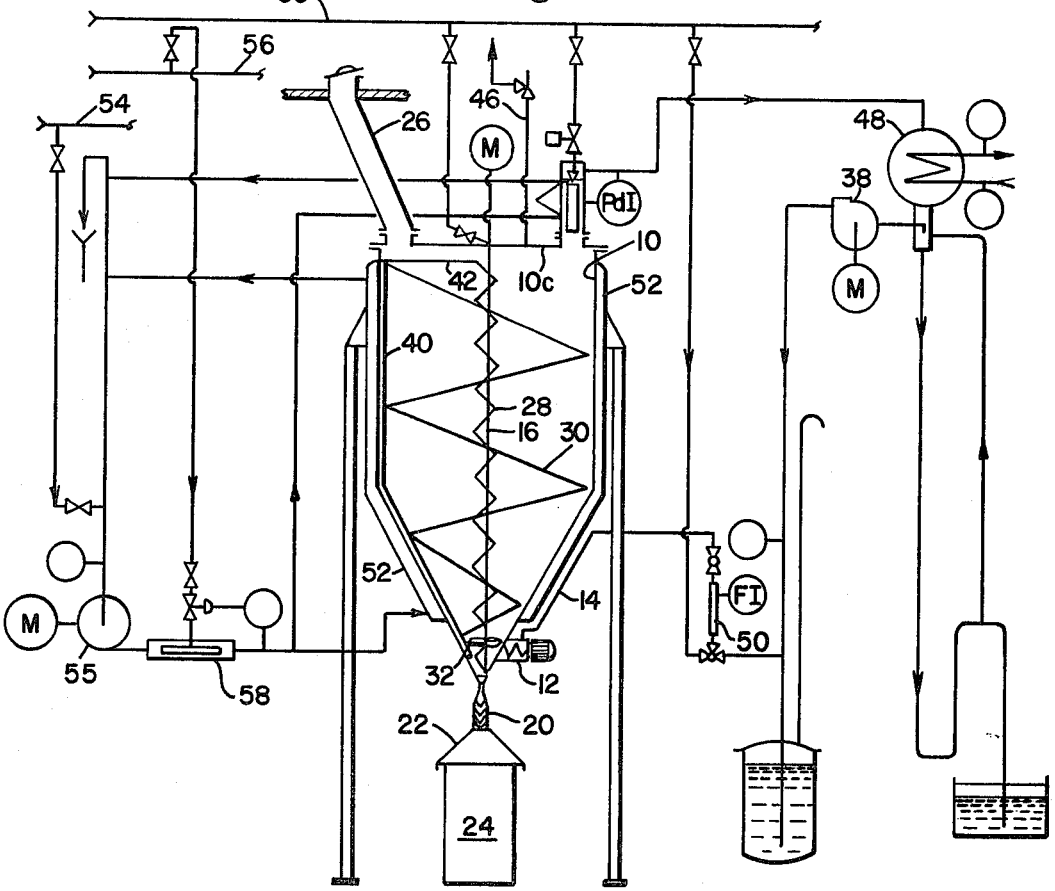
Figure 2:
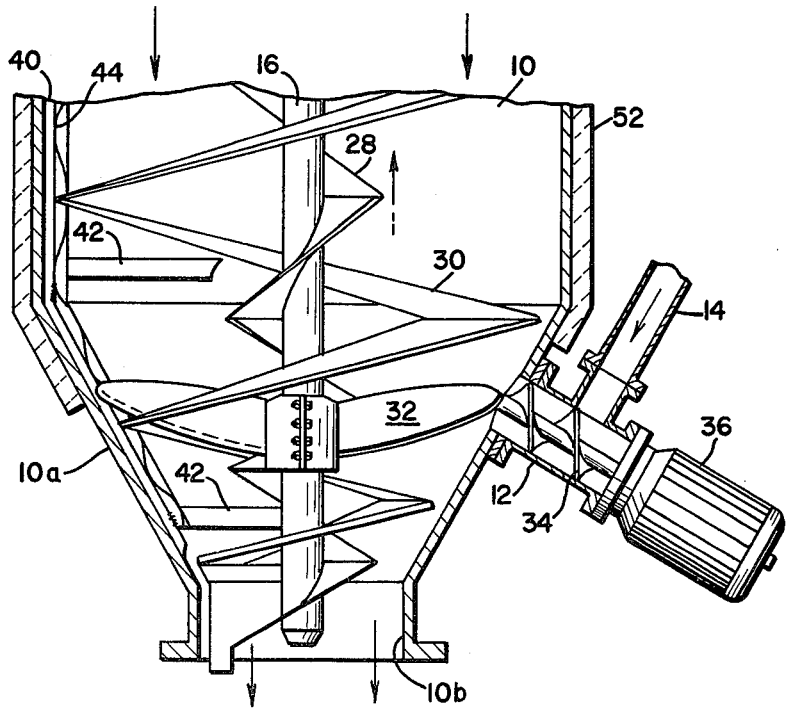

In the accompanying drawings:

FIG. 1 is a schematic view of a complete plant with the dryer according to this invention; and FIG. 2 shows a fragmentary view of the dryer with the vessel and gas feed means in section, and showing the agitating means in elevation.

With brief reference to the Figures at this time, though more complete reference thereto will be made hereinafter, the product to be dried is charged from above into the dryer vessel 10 which can be heated and also can be rendered vacuum- and pressure-tight. The product drops downwardly and is moved by the agitating system. The dry gas (arrow in dashed lines, FIG. 2) entering the dry gas feed 12 via conduit 14, flows from this dry gas feed 12 countercurrently to the moist product (arrow in solid lines, FIG. 2). The clearance between the resilient blade and scrapers 12 (carried by shaft 16) and the inner wall of the vessel 1 is at most 5 mm., whereby a caking of the product to be dried on the inner wall is effectively avoided. Various drying gases, as nitrogen, can be used, but of course, the dryer can also be operated with air, for example in case of water-moist products, where the moisture can escape to the outside together with the dry gas, and the condenser is by-passed. If it is desired to lower the moisture content of the product to almost 0%, the dryer may be connected to a vacuum system, and the product subjected to a final drying step with the use of a minimum gas stream.

Where the boiling point of the solvent in the moist product is relatively high and the heating temperature must be substantially lower due to the temperature sensitivity of the product to be dried, an evaporative drying process is too time-consuming, and a true vacuum-drying operation is advantageous. In this process, the dry gas stream feed from below into the dryer is controlled to be so small that the vacuum does not substantially deteriorate. A substantially faster drying time is thus achieved.

With more particular reference to FIG. 2, the vessel 10 is generally cylindrical but with a downwardly conical lower end portion **10*a* terminating in a product discharge opening 10*b* which may be valved or otherwise selectively opened or closed, as the case may be for batch drying and dustfree discharge of the dried product through a flexible conduit 20 and lid 22 to a collection receptacle 24 (see, FIG. 1). The upper end of the vessel has a suitable closure 10*c* through which products are delivered to the vessel from conduit 26 (see, FIG. 1). A shaft 16, motor driven as shown, is centrally and vertically mounted within the vessel 10 and carries a screw type agitator conveyor 28 of relatively short radial extent for rotation therewith. A skeletal type helical scraper and agitator 30 is also carried by the shaft for rotation therewith and is of greater radial extent for proximate surface positioning relative to the inner surface of the vessel for disturbance and removal of products therealong. The center axially disposed portions of the helix 30 may be secured to the shaft 16. The screw assemblies 28, 30 extend substantially throughout the vertical extent of the vessel, including the tapered lower portion 10***a* thereof. Within this lower portion of the vessel, there is provided a blade structure 32 fixed to the shaft 16 substantially at the transverse level of the inlet from the gas feed conduit 12. The blade structure is oriented in the nature of a marine propeller with the tip portions traversing across the gas feed inlet for wiping and with the orientation of the blades inducing suction on the gas feed inlet to assist in distribution of the drying gas and at the same time preventing ingress of the product, particularly if tacky, into the gas feed inlet. Also assisting in egress of drying gas through the gas feed inlet and prevention of product entry, this conduit 12 has included therein a screw conveyor 34 driven by an electric or pneumatic motor 36.

As thus far described, the vessel is charged with the product to be dried through 26 which may then be closed. Drying gas (air, nitrogen or similar) may be urged by a motor driven fan 38 (FIG. 1) through conduit line 14 to gas feed conduit 12 from which it is urged to the interior of the vessel and directed substantially transversely of the axis of the discharge opening 10*b* and under additional influence of the blade structure 32 which also tends to urge the gas upwardly through the product being elevated and distributed by the screws 28, 30 which latter tends to disturb any tendency of the product to gather on the interior surface of the vessel. After predetermination, the thusly distributed product will tend toward the discharge opening for controlled access to the collection receptacle 24. Thus, it will be appreciated that the product is distributed within the vessel for drying by the gas entering and directed substantially across the discharge opening at the bottom of the vessel. The product is prevented from gaining access to the gas feed inlet conduit 12 by the screw means 34 therein and the wiping thereacross of the blade structure 32, this being particularly advantageous with tacky product, and the blade structure urges the gas upwardly through the distributed product which is constantly disturbed and elevated thereby and by the screw means 28, 30.

In addition to the screw agitation and distribution of the product, a resilient scraper blade 40 may be provided for closer wiping of the interior surface of the vessel by extending substantially throughout the vertical extent of the blade may be mounted by lateral arms 42 from the shaft 16 and perhaps augmented by suitable attachment to adjacent portions of the helical blade 30. Additional resiliency may be provided for mounting of the blade by spring mounting means 44.

The incoming drying gas may be vented through line 46 if pressure in the vessel surpasses wanted pressure during operation. During operation, the gas picks up water and/or organic solvents from the product in the vessel and the gas is recirculated by proper manipulation of valved lines (FIG. 1) through a condenser 48 for removal of the picked up solvents or moisture. Where the drying gas, as air, may contain dust particles of the dried product after passage through the vessel, such gas passes through a filter 50 before entry into the condensor. During normal operation the vessel is heated under controlled conditions during the product drying and for such purpose, the vessel is jacketed, as at 52, to which cold water may be directed from line 54 through the valved conduit lines and circulating pump 55 (FIG. 1) or steam, and the water is heated by steam from line 56 in the heat transfer device 58. Where nitrogen is to be used in or for the drying gas, this may be obtained from conduit line 60 for entrance and/or recirculation through the valved conduit lines illustrated in FIG. 1.

The drying vessel is charged by inlet 25. After dosing, the gas circuit system is filled by selective manipulation of the valved conduit lines with an inert heating gas, like nitrogen, and operated by the blower 38. After that, the vessel will be heated by hot water by means of jacket 52. The heating gas passes the moist product and leaves the vessel through dust filter 50. The gas enters the condenser 48 for removal of the picked up solvents or moisture. The clean gas returns through the blower 38 to the vessel enterring by conduit 12. The gas pressure at filter 50 is controlled by means of the pressure difference indicator Pd I. The amount of circulating gas is measured by means of the flow indicator F I.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Apparatus adapted for drying products generally moistened throughout, as by organic solvents; and comprising a generally cylindrical vertically oriented vessel with a downwardly conically tapered lower end portion terminating in a product discharge opening, and a closed top end portion with means for admitting products to the vessel; agitating means centrally mounted for rotation within the vessel for distributing products therein and including a rotating shaft centrally and vertically disposed in fixed position within the vessel and carrying a skeletal helical screw of a radial extent at least approximating surface contact with the interior surface of the vessel and extending substantially throughout the vertical extent thereof including the tapered lower end portion to the product discharge opening; and conduit means including a feed conduit for directing drying gas to the tapered lower end portion of the vessel above and transversely across the discharge opening and the path of the helical screw in the tapered lower end portion of the vessel for movement through the agitated products and in countercurrent to movement of the products toward the discharge opening within the outer radial extent of the skeletal helical screw.

2. Apparatus as claimed in claim 1, wherein there is provided impeller means for the gas and including driven screw means in the gas feed conduit serving to prevent entry of the products into the conduit means.

3. Apparatus as claimed in claim 1 wherein there is provided blade means in the form of a marine propeller rotatably mounted within the vessel at substantially the inlet of the gas feed conduit and traversing the path of the helical screw and oriented to induce suction on the inlet of the conduit to assist ingress of drying gas and resist access of products to the conduit.

4. Apparatus as claimed in claim 1 wherein the rotating shaft carries a screw type conveyor of limited radial extent less than that of the helical screw.

5. Apparatus as claimed in claim 4 wherein the shaft carries blade means in the form of a marine propeller within the tapered conical end portion of the vessel at substantially the level of the gas feed conduit and oriented to induce suction on the inlet of the conduit to assist ingress of drying gas and to resist access of the products to the conduit.

6. Apparatus as claimed in claim 5 wherein the gas feed conduit includes driven screw means serving to also prevent entry of the products into the conduit.

7. Apparatus as claimed in claim 6 wherein there if provided resilient scraper means rotating with the shaft and extending vertically throughout substantially the extent of the inner surface of the vessel including the tapered lower end portion thereof and in wiping contact therewith.

8. Apparatus as claimed in claim 1, wherein the gas conduit means includes a recirculating gas conduit path including a condenser system therein.

9. Apparatus as claimed in claim 1 wherein a blade type marine propeller is rotatably mounted transversely of an intermediate portion of the tapered lower end portion of the vessel to wipe across the drying gas conduit opening for effecting upward air flow through the vessel in counter-current to downward movement of the products within the skeletal helical screw toward the discharge opening.

10. Apparatus as claimed in claim 9 wherein the shaft carries a screw-type conveyor of lesser radial extent than that of the skeletal helical screw and with both said screw type conveyor and said skeletal helical screw operating substantially throughout the vessel including the tapered lower end portion thereof, and wherein a scraper blade extends substantially throughout the vessel including the tapered lower end portion thereof and rotating with the shaft in wiping contact with the inner surface of the vessel to prevent product caking on the inner surfaces of the vessel and thus subject the product to the screw agitation and air countercurrent.

* * * * *